US006105332A

United States Patent [19]

Boyadjian

[11] Patent Number: 6,105,332

[45] Date of Patent: Aug. 22, 2000

[54] ANCHORING PLATE

[76] Inventor: Shahe K. Boyadjian, 8033 Louise Ave., Northridge, Calif. 91325

[21] Appl. No.: 08/593,264

[22] Filed: Jan. 29, 1996

Related U.S. Application Data

[63] Continuation-in-part of application No. 08/310,305, Sep. 22, 1994, abandoned.

[51] Int. Cl.[7] ..... E04B 1/38

[52] U.S. Cl. ..... 52/698; 411/466; 52/293.3

[58] Field of Search ..... 52/293.3, 295, 52/296, 297, 298, 698, 699; 411/461, 462, 463, 464, 465, 466

[56] References Cited

U.S. PATENT DOCUMENTS

| | | | |
|---|---|---|---|
| 2,903,879 | 9/1959 | Williams | 52/293.3 X |
| 2,937,418 | 5/1960 | Sanford | 411/466 X |
| 3,501,181 | 3/1970 | Jureit | 411/466 |
| 3,852,931 | 12/1974 | Morse et al. | 52/293.3 |
| 3,972,168 | 8/1976 | Allen | 52/698 |
| 4,543,763 | 10/1985 | Ernst et al. | 52/698 |
| 4,872,298 | 10/1989 | Klemic, Jr. | 52/295 X |
| 5,060,436 | 10/1991 | Delgado, Jr. | 52/295 |
| 5,307,603 | 5/1994 | Chiodo | 52/698 |
| 5,379,563 | 1/1995 | Tinsley | 52/295 |
| 5,448,861 | 9/1995 | Lawson | 52/293.3 X |
| 5,546,723 | 8/1996 | Jones | 411/466 X |

*Primary Examiner*—Richard Chilcot
*Attorney, Agent, or Firm*—Jack C. Munro

[57] ABSTRACT

A sill plate that is mounted on a cement footing of a building structure with anchor bolts being fixedly embedded within the cement footing in spaced apart locations with these anchor bolts protruding from the uppermost surface of the cement footing. Each anchor bolt is to be located within an oversized hole formed in the sill plate. An anchoring plate is to be fixedly secured to the sill plate with there being a separate anchoring plate for each anchor bolt. There is a closely conforming hole formed within the anchoring plate through which this anchor bolt is to extend. A fastening arrangement is utilized to fixedly secure each anchoring plate on the sill plate.

2 Claims, 1 Drawing Sheet

ANCHORING PLATE

This application is a continuation-in-part of patent application Ser. No. 08/310,305, filed Sep. 22, 1994, entitled ANCHORING PLATE now abandoned.

BACKGROUND OF THE INVENTION

1) Field of the Invention

The field of the invention relates to construction of building structures and more particularly to an anchoring plate to be utilized between an anchor bolt that is mounted in conjunction with a sill plate which precisely positions the anchor bolt relative to the sill plate preventing slight movements therebetween.

2) Description of the Prior Art

Concrete is commonly used within footings and slabs for buildings, houses, patio covers and other similar types of structures. It is common to embed anchor bolts within the concrete with these anchor bolts protruding from the upper surface of the concrete to then be used to attach the walls of the building, house or patio cover to the concrete. An anchor bolt is normally constructed of metal with an inner threaded end and an outer and which is bent forming a hook configuration. This hook configuration is designed to be embedded within the cement with the threaded end of the hook to extend above the level of the cement. It is the threaded end to which the wall of the building, house or patio cover is to be attached.

This attachment procedure is to be accomplished by the use of a sill plate. Generally a sill plate takes the form of a wooden member, generally a two by four, that is to be placed with its longest cross-sectional dimension resting against the uppermost surface of the cement footing. Formed within this sill plate is a plurality of spaced apart holes with an anchor bolt to extend through each hole. The normal installing procedure for the sill plate is, as the building, house or patio cover is being constructed, for the sill plate to be positioned directly against the cement footing. The position for each hole located within the sill plate is then "eyeballed" on the sill plate and a mark is made at each position. The sill plate is then drilled with a hole at each position. Because slight misalignments always occur, it is common for this hole to be made one and a half to two times larger in diameter than what is actually required for the cross section of the anchor bolt. In the past, after the sill plate has been placed in conjunction with the anchor bolts, it has been common to merely use nuts in conjunction with each anchor bolt to fixedly secure the sill plate onto the cement footing.

The problem is that because of the oversized holes in the sill plate, there really is not a precise fixing of the sill plate on the cement footing. The lumber that is used contains a significant amount of moisture. After a period of time, the connection between the sill plate and anchor bolts will lossen due to the sill plate "drying out", causing shrinkage. Upon the building structure incurring some kind of unusual movement, such as in an earthquake, twisting, turning and slipping of the sill plate can occur on the cement footing. This will cause walls to assume non-vertical configurations producing extensive cracks to plaster and wallboard requiring a substantial amount of expensive repairs.

If the sill plate could be precisely fixedly located relative to the anchor bolt, this movement of the sill plate could be avoided during an earthquake thereby avoiding such expensive repairs.

SUMMARY OF THE INVENTION

The structure of the present invention is intended to be used in conjunction with a sill plate which comprises a wooden structural member which is to be placed against a cement footing of a building or house. Embedded within the cement footing is a plurality of anchor bolts with these anchor bolts being located in a spaced apart manner. Each anchor bolt protrudes from the upper surface of the cement footing. Oversized holes are formed within the sill plate with there being a corresponding hole for each anchor bolt. The sill plate is then placed on the uppermost surface of the cement footing with each anchor bolt connecting with a hole formed in the sill plate and protruding exteriorly therefrom. An anchoring plate has a hole which closely conforms to be just slightly larger in size than the cross-sectional dimension of the anchor bolt. The anchoring plate is to be placed on the sill plate with the anchor bolt protruding through the hole of the anchoring bolt. The anchoring plate includes a temporary fastening arrangement such as a plurality of embedding spikes. When the anchoring plate is placed against the sill plate, it is to be hammered into position fixing the placement of the anchoring plate on the sill plate. Permanent fixation of the anchoring plate is accomplished through the use of a separate series of holes formed within the anchoring plate with each of these holes to engage with a screw fastener that embeds within the sill plate.

The primary objective of the present invention is to utilize an anchoring plate in conjunction with a sill plate that eliminates any movement of the anchoring bolt within the oversized hole formed within the sill plate that might occur upon the building structure receiving an exterior movement force such as in an earthquake.

Another objective of the present invention is to construct an anchoring plate to be used in conjunction with a sill plate which can be manufactured relatively inexpensively and thereby sold to the ultimate consumer of an inexpensive price.

DETAILED DESCRIPTION OF THE PREFERRED EMBODIMENT

Figure 1:
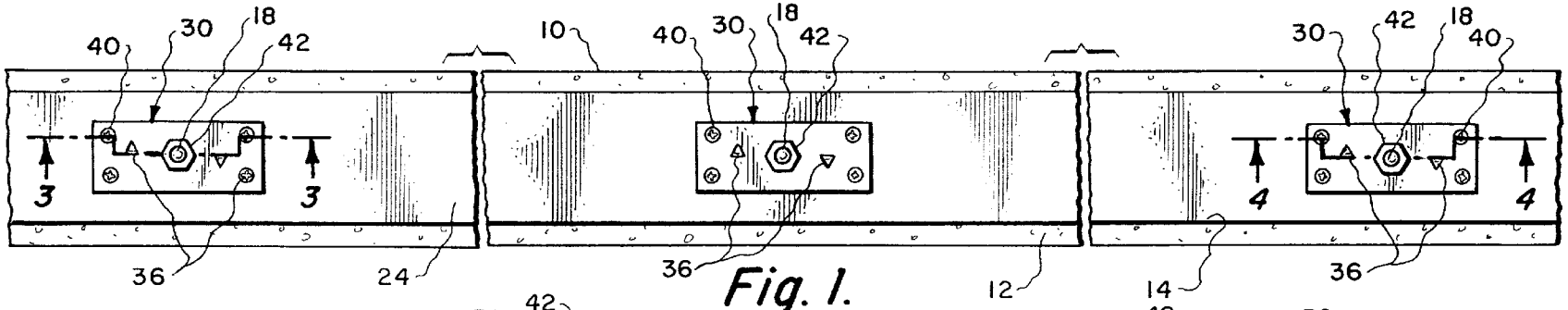
FIG. 1 is a top plan view of a sill plate mounted in conjunction with a cement footing showing a plurality of anchoring plates of the present invention mounted in conjunction with each anchor bolt that protrudes above the upper surface of the sill plate.

Referring particularly to the drawing, there is depicted wood boards 10 and 12 which are laid in parallel spaced apart arrangement with the longest dimension of the boards 10 and 12 being located vertical. The boards 10 and 12 would generally be identical in configuration. Between the boards 10 and 12 is located a space 14. It is within this space 14 that cement 16 is to be poured and will form the footing for a building or a patio structure (not shown). It is to be understood that once the cement 16 is poured and hardened, the boards would be removed.

Within the cement 16 there is embedded a plurality of anchor bolts 18. Each anchor bolt 18 is basically cylindrical and generally is between one quarter of an inch to over an inch in diameter. The diameter of the length of the anchor bolt 18 would be selected according to the requirements of the particular installation. Also, the length of the anchor bolt would generally vary.

Normally, the anchor bolt 18 will be constructed of metal such as steel. Anchor bolt 18 has an outer end formed into a hook 20 with the inner end of the anchor bolt 18 including a series of screw threads 22. During embedding of the anchor bolt 18 within the cement 16, the anchor bolt 18 should be located at the middle of the width of space 14. Selecting of the longitudinal positions of the anchor bolts 18 relative to the space 14 is according to the architectural requirements. Such architectual requirements generally require that the anchor bolts 18 be longitudinally spaced apart a distance of one foot, eighteen inches, two feet or three feet.

Walls are constructed of the building structure by being secured at their lower end to the sill plate 24. The sill plate 24 generally comprises a single unitary structural wooden member with a two by four being commonly used. However, other size wooden members could be utilized such as two by sixes. The sill plate 24 has formed therein a plurality of holes 26. Each hole 26 is to connect with an anchor bolt 18. In order to insure that each anchor bolt 18 is to connect with a hole 26, it is noted that each hole 26 is formed substantially larger in size than the cross-sectional dimension of the anchor bolt 18. This oversizing arrangement is to assure that when the sill plate 24 is placed against the uppermost surface 28 of the footing 16, that an anchor bolt will connect with each hole 26. If the holes 26 are just precisely sized to be just slightly larger than each anchor bolt 18, then upon placing of the sill plate 24 on the uppermost surface 28, then one, two or three of the anchor bolts 18 will connect with the respective holes 28 but invariably at least one anchor bolt 18 will not precisely align with a hole 26. In order to compensate for these slight misalignments, the holes 26 are all formed oversized.

In order to compensate for the oversized holes 26, there is utilized the anchoring plate 30 of the present invention. Each anchoring plate 30 is basically constructed of thin metal sheet material and is in a basic rectangular shape. However, it is to be understood that any desirable configuration could be utilized other than rectangular, but rectangular is a common configuration. Formed within each anchoring plate 30 is a centrally located hole 32. An anchoring plate 30 is to be placed against the exposed horizontal surface 34 of the sill plate 24 so that an anchor bolt 18 will protrude exteriorly of the hole 32. The installer places an anchoring plate 30 in conjunction with each anchor plate 18. The size of hole 32 is just slightly larger (such as 0.001 of an inch) than the diameter of anchor bolt 18. It is desirable that this be an extremely close tolerance between anchor bolt 18 and plate 30 producing a tight (non-sloppy) connection between the anchor bolt 18 and its anchoring plate 30. The installer makes sure that the sill plate 24 is in its precisely correct position. Each anchoring plate 30 includes a temporary fastening arrangement in the form of sharpened protuberances 36. The installer then hammers slightly on the plate 30 causing the protuberances 36 to embed within the sill plate 24. This temporarily fixes in position each anchoring plate 30.

Each anchoring plate 30 also includes a plurality (four in number) of a spaced apart arrangement of screw fastener receiving holes 38. Each hole 38 is to receive a conventional screw fastener 40. The screw fasteners 40 are then to be secured within the sill plate 24. This permanently fixes in position the anchoring plate 30 relative to the sill plate 24.

Figure 4:
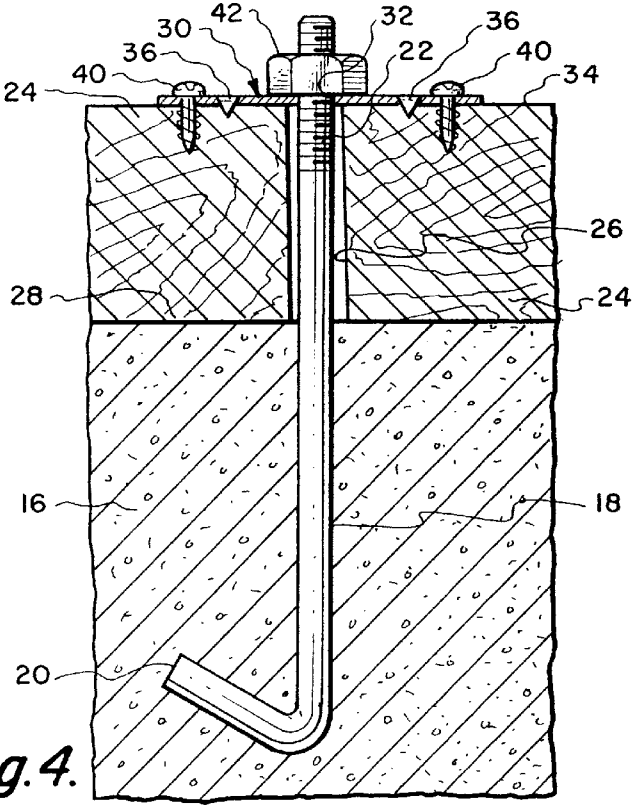
FIG. 4 is a cross-sectional view taken along line 4—4 of FIG. 1, which is almost identical to the cross-sectional view of FIG. 3 with the exception that the anchor bolt is shown in a slightly different position relative to the sill plate.
Figure 3:
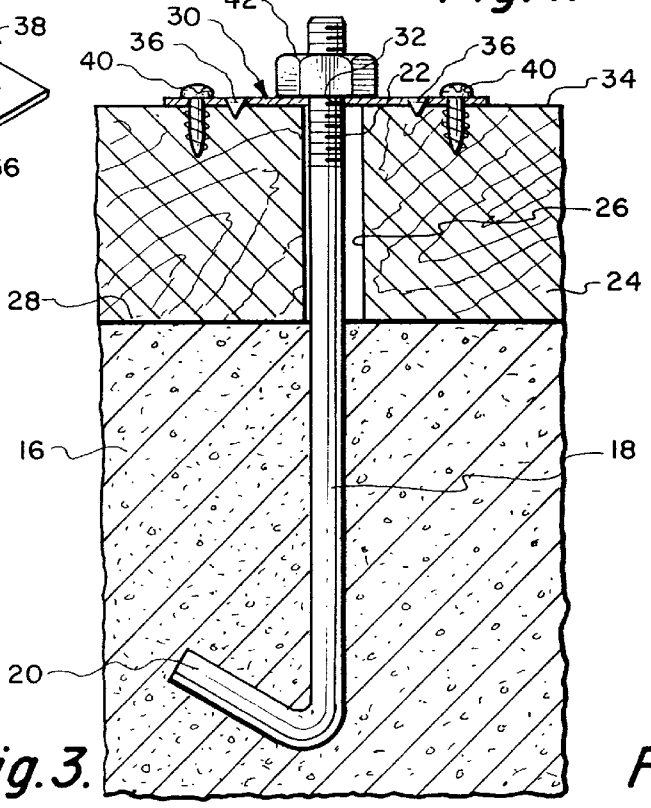
FIG. 3 is a cross-sectional view taken along line 3—3 of FIG. 1.
Figure 2:
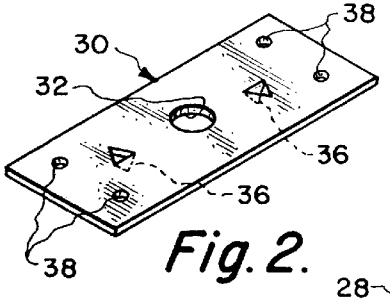
FIG. 2 is an isometric view of the anchoring plate of the present invention.

After the anchoring plates 30 are so positioned in conjunction with the anchor bolt 18, the installer then places a nut 42 in conjunction with the threaded end 22 of each anchor bolt 18. Each nut 42 is then to be tightened securely against its respective anchoring plate 30 thereby fixing in position the sill plate 24 relative to the anchor bolt 18. It can be seen by comparing FIGS. 3 and 4 of the drawing that, during the installation process of the sill plate 24, that one anchor bolt 18 may be located in one position within the oversized hole 26 and then another anchor bolt 18 would occupy a slightly different position within its oversized hole 26. However, once the anchoring plates 30 are fixedly mounted on the sill plate 24, there will essentially be no movement permitted between the sill plate 24 and the anchor bolt 18 upon the building structure encountering a significant outside force such as normally occurs in an earthquake.

What is claimed is:

1. In combination with a cement footing of a building structure, said cement footing having an uppermost surface being exposed to the ambient, said cement footing having a plurality of embedded anchor bolts fixedly located within said cement footing, said anchor bolts located in a spaced apart manner, each said anchor bolt protruding from said uppermost surface of said cement footing, a wood sill plate comprising an elongated unitary structural member, said sill plate having a plurality of first holes located in a spaced apart manner, the spacing and alignment of said first holes substantially corresponding to the spacing and alignment of said anchor bolts, each said first hole being substantially larger in size relative to the transverse cross section of a said anchor bolt, said sill plate to be located on said uppermost surface with a single said anchor bolt to pass through each said first hole, the improvement comprising:

an anchoring plate to be mounted in conjunction with each said anchor bolt with there being a separate said anchoring plate for each said anchor bolt, said anchoring plate being separate from said anchor bolt, each said anchoring plate having a second hole, each said second hole closely conforming in size to be just slightly larger than the cross sectional size of its respective said anchor bolt, each said anchor bolt to be located within a said second hole;

fastening means for fixing in position each said anchoring plate to said sill plate, said fastening means including a temporary fastener arrangement and a permanent fastener arrangement, whereby after installation of said anchor bolts and curing of said cement footing each said anchoring plate is permanently installed establishing a close tolerance, tight connection between its respective said anchor bolt, said anchoring plate and said sill plate;

said temporary fastener arrangement comprising a plurality of sharpened protuberances formed within each said anchoring plate, said sharpened protuberances to be embedded within said sill plate upon mounting of each said anchoring plate about its respective said anchor bolt with each said anchoring plate being located against said sill plate, thereby fixing in position each said anchoring plate preventing movement of such during installation of said permanent fastener arrangement; and said permanent fastener arrangement comprising a plurality of screw fasteners, said screw fasteners to be embedded only in said sill plate.

2. The combination as defined in claim 1 wherein:

said second hole being circular, each said anchor bolt being cylindrical, both said second hole and each said anchor bolt having a diameter, said second hole being approximately 0.001 of an inch larger in diameter than the diameter of said anchor bolt.

* * * * *